US006769197B1

(12) United States Patent
Tai

(10) Patent No.: US 6,769,197 B1
(45) **Date of Patent: *Aug. 3, 2004**

(54) HAND DRYER

(75) Inventor: Yasushi Tai, Kanagawa (JP)

(73) Assignee: Matsushita Ecology Systems Co., Ltd., Aichi (JP)

( * ) Notice: Subject to any disclaimer, the term of this patent is extended or adjusted under 35 U.S.C. 154(b) by 23 days.

This patent is subject to a terminal disclaimer.

(21) Appl. No.: 10/381,431

(22) PCT Filed: Sep. 27, 2001

(86) PCT No.: PCT/JP01/08425

§ 371 (c)(1),
(2), (4) Date: Mar. 28, 2003

(87) PCT Pub. No.: WO02/28250

PCT Pub. Date: Apr. 11, 2002

(30) Foreign Application Priority Data

Sep. 29, 2000 (JP) ..... 2000-299767

(51) Int. Cl.[7] ..... F26B 19/00
(52) U.S. Cl. ..... 34/90; 34/197; 34/202
(58) Field of Search ..... 34/87, 88, 89, 34/90, 195, 197, 202, 218, 219, 235

(56) References Cited

U.S. PATENT DOCUMENTS 3,643,346 A * 2/1972 Lester ..... 34/202
3,667,134 A * 6/1972 Rockson ..... 34/60
3,766,397 A * 10/1973 Rockson ..... 250/432 R
4,336,619 A * 6/1982 Hinkel et al. ..... 4/619
4,914,833 A * 4/1990 Pilolla et al. ..... 34/526
5,031,337 A * 7/1991 Pilolla et al. ..... 34/526
5,146,695 A * 9/1992 Yang ..... 34/90
5,186,360 A * 2/1993 Mease et al. ..... 222/63
5,459,944 A * 10/1995 Tatsutani et al. ..... 34/202
5,974,685 A * 11/1999 Hironaka ..... 34/202
2002/0020077 A1 * 2/2002 Haraga et al. ..... 34/576

FOREIGN PATENT DOCUMENTS

| | | |
|---|---|---|
| JP | 21393 | 2/1986 |
| JP | 10-257994 | 9/1998 |
| JP | 2000-184987 | 7/2000 |

* cited by examiner

*Primary Examiner*—Henry Bennett
*Assistant Examiner*—Andrea M. Ragonese
(74) *Attorney, Agent, or Firm*—Armstrong, Kratz, Quintos, Hanson & Brooks, LLP

(57) ABSTRACT

A hand dryer has a body case with a blower with an air-blowing nozzle on its lower surface, and a water receiver disposed below the body case and forming a hand-inserting space with the body case. The water receiver is detachable from the body case. The water receiver has a receiving portion which covers a lower front surface, a back surface which is connected to the receiving portion and which covers a wall surface, and a pair of side surfaces, connected to the receiving portion, rising from opposite sides of the back surface. Water receiver-side retaining portions are on upper portions of the side surfaces, body case-side retaining portions are on opposite sides of the body case, and the water receiver is mounted to the body case by the water receiver-side retaining portions and the body case-side retaining portions. The water receiver-side retaining portions are hooked on the body case-side retaining portions, so that the water receiver can be fixed.

8 Claims, 12 Drawing Sheets

HAND DRYER

TECHNICAL FIELD

The present invention relates to a hand dryer for drying wet hands after hand washing at a lavatory, a bathroom and the like.

BACKGROUND TECHNIQUE

Conventionally, a hand dryer of this kind is known and described in Japanese Patent Application Laid-open No. H10-99235.

The described hand dryer will be explained with reference to FIG. 17.

As shown in FIG. 17, a body case 101 fixed to a wall surface comprises a front case 102 and a water-receiving bowl 103 which projects from a lower portion of the body case 101. A drying space 102*a* is formed between the front case 102 and the water-receiving bowl 103. Blower means 104, heating means 105 and control means 108 are provided in the front case 102. The front case 102 is provided at its lower end with an air-blowing nozzle 106 which is oriented toward the drying space 102*a*. The water-receiving bowl 103 is provided at its back lower portion with an air-intake opening 117 for drawing air into the blower means 104. The water-receiving bowl 103 has a communication tube 113 which is in communication with a water-receiving cup 114. The water-receiving cup 114 is disposed below the water-receiving bowl 103, and is detachably mounted to the water-receiving bowl 103 from its front surface side. The water-receiving cup 114 is provided at its upper surface with a water-receiving cup cover 121. The air-intake opening 117 is provided with a filter frame 122.

In the above structure, if a wet hand is inserted into the drying space 102*a*, air is drawn from the air-intake opening 117 by the blower means 104, the air passes through the heating means 105 and becomes hot air, and the hot air is injected from the air-blowing nozzle 106. Water attached to the hand is scattered by the air injected from the air-blowing nozzle 106 to dry the hand. At that time, drops of water scattered from the hand are gathered into the water-receiving bowl 103, and are gathered from the communication tube 113 into the water-receiving cup 114.

In such a conventional hand dryer, since drops of water scattered from the hand are received into the water receiver and accumulated in the water-receiving cup 114, a wall or a floor is not made dirty. However, there is a case in which a water receiver is not required depending upon use or a place such as an upper portion of a sink in a bathroom. In a narrow place, the water receiver becomes an obstacle, or the water receiver can not be mounted in some cases. Further, when the water receiver is made dirty, since the water receiver can not be washed whole, there is a problem in terms of hygienics and appearance.

Therefore, it is required that a user can freely attach and detach the water receiver depending upon place or use, and when the water receiver is made dirty, only the water receiver can be detached and washed whole.

When a retained-state releasing operation of the water receiver is carried out from outside of the side surface of the water receiver or from side front surface of the water receiver, a side wall hinders the operation and fingers can not move strongly and thus operability is inferior, and design of outward appearance is deteriorated. Thus, it is required that the retained-state releasing operation of the water receiver can easily be carried out without being influenced by the wall surface, and the outward appearance is not deteriorated.

If the water receiver is designed such that it can be detached from the body case, a connection portion between the water receiver and the body case becomes weak, rattling of front and rear portions of the water receiver becomes great, and there is an adverse possibility that the water receiver comes off and falls out.

Therefore, when the water receiver is designed such that it can be detachable from the body case, it is especially required that the rattle of the front and rear portions of the water receiver is not generated.

When the hand dryer is used in a state in which the water receiver is only retained to the body case, if a child tampers and applies a load to the water receiver, there is an adverse possibility that the retained state is released and the water receiver falls out.

Therefore, it is required that even when a slight load is applied to the water receiver, there is no adverse possibility that the water receiver comes off and falls out.

When opposite sides of the water-receiving cup 114 are held, since left and right rails are excessively separated from each other, it is difficult to fit the water-receiving cup 114 to the left and right rails at the same time, and the operability is inferior.

Therefore, it is required to enhance the attaching and detaching performance of the water-receiving cup without increasing costs and the number of assembling steps.

When a mounting position of the hand dryer body case is close to a receptacle and an excessive length of a power cord remains, the power cord encumbers, and the appearance of the mounting place is deteriorated.

Therefore, it is required that the remaining power cord can be dispose of so that the power cord does not encumber or deteriorate the landscape.

When water which was scattered at the time of use is drawn from an intake opening or water enters into the body case by condensation, the water is accumulated, which causes leakage or corrosion and affects an electrical component.

Therefore, it is required that even if water enters into the body case, the water is not accumulated in the body case and is discharged out, the electrical component is not adversely affected, and the discharged water does not drop onto the floor.

When the front case 102 is designed such that it can freely be opened and closed in view of service and construction work, a LED display portion must be provided on the side of the body case not on the side of the front case because a leadwire encumbers. However, when the front case 102 is opened and closed, if the front case or hand hits against the LED and legs of the LED fall, positions of a display hole and the LED are misaligned from each other.

Therefore, it is required that even when the front case 102 is opened and closed, positions of the display hole and the LED can be aligned to each other with small number of parts and small number of assembling steps.

The present invention has been achieved to solve such conventional problems, and it is an object of the invention to provide a hand dryer in which the hand dryer can be used in a state in which a user can freely attach and detach the water receiver depending upon place or use, and when the water receiver is made dirty, only the water receiver can be detached and washed whole.

It is another object of the invention to provide a hand dryer in which excessive power cord can be disposed of such that the excessive power cord does not encumber for use and the landscape is not deteriorated.

It is another object of the invention to provide a hand dryer in which even if water enters into the body case, the water is not accumulated in the body case, the water can be discharged out, an electrical component is not adversely affected, and discharged water does not fall onto the floor.

It is another object of the invention to provide a hand dryer in which even if a front case is opened and closed, the positions of a display hole and a LED are not deviated from each other, and in which there are small costs and a small number of assembling steps.

DISCLOSURE OF THE INVENTION

A hand dryer according to a first aspect of the present invention comprises a body case provided therein with a blower means and at its lower surface with an air-blowing nozzle, and a water receiver disposed below the body case and forming a hand-inserting space between the body case and the water receiver, the water receiver is detachable with respect to the body case in a state in which the body case is disposed, the water receiver comprises a receiving portion which covers a lower front surface, a back surface which is connected to the receiving portion and which covers a wall surface, and a pair of side surfaces which are connected to the receiving portion to form rising portions from opposite sides of the back surface, water receiver-side retaining portions are respectively provided on upper portions of the side surfaces, body case-side retaining portions are respectively provided on opposite sides of the body case, the water receiver is mounted to the body case by the water receiver-side retaining portions and the body case-side retaining portions.

According to this aspect, if a user grasps the side surfaces of opposite sides of the water receiver and sets the water receiver-side retaining portions to the body case-side retaining portions, the water receiver-side retaining portions are hooked on the body case-side retaining portions, and the water receiver can be fixed.

Therefore, the user can freely attach and detach the water receiver depending upon place or use, and when the water receiver is made dirty, only the water receiver can be detached and washed whole.

According to a second aspect of the invention, in the hand dryer of the first aspect, retained-state releasing means for releasing a retained state between the water receiver-side retaining portion and the body case-side retaining portion is provided on each of the inner surfaces of the side surfaces constituting the water receiver.

According to this aspect, when the user detaches the water receiver, since the retained-state releasing means is provided on each of the inner surfaces of the side surfaces, the operation can be carried out using thumbs which can easily be strained.

Therefore, the hand dryer is disposed in a narrow space, the water receiver can easily be attached and detached, and the outward appearance is not deteriorated by the retained-state releasing means.

According to a third aspect of the invention, in the hand dryer of the first aspect, the pair of side surfaces constituting the water receiver are respectively provided at their upper portions with water receiver-side connection portions, the body case is provided at its opposite, sides with body case-side connection portions, respectively, and a guider capable of slide the water receiver in a vertical direction with respect to the body case is constituted by the water receiver-side connection portion and the body case-side connection portion.

According to this aspect, when the water receiver is connected to the body case, since the water receiver-side connection portion is fitted along the body water receiver-side connection portion, the connection between the body case and the water receiver is strengthened by the guider, and the rattle in the front and rear portions of the water receiver can be eliminated.

According to a fourth aspect of the invention, in the hand dryer of the first aspect, the back surface constituting the water receiver is provided at its upper central portion with a water receiver-fixing screw which connects the body case to the water receiver.

According to this aspect, the body case and the water receiver can reliably be fixed, and an adverse possibility that the water receiver comes off and falls out is eliminated, and a safe hand dryer can be obtained.

According to a fifth aspect of the invention, in the hand dryer of the first aspect, a water-receiving cup is detachably mounted to a lower portion of the water receiver.

According to this aspect, since only the water-receiving cup can be attached and detached, water can easily be discharged and the water-receiving cup can easily be washed.

A hand dryer according to a sixth aspect of the invention comprises a body case provided therein with a blower means and at its lower surface with an air-blowing nozzle, and a water receiver disposed below the body case and forming a hand-inserting space between the body case and the water receiver, the water receiver is detachable with respect to the body case in a state in which the body case is disposed, the water receiver is provided at its lower portion with a water-receiving cup, the water receiver is provided at its substantially central portion of its back bottom with a reversed T-shaped rail extending in a longitudinal direction, the water-receiving cup is provided at its upper surface with a guide groove formed by notching the upper surface from its rear portion.

According to this aspect, if the guide groove of the water-receiving cup is inserted to the reversed T-shaped rail, the water-receiving cup is supported by the reversed T-shaped lateral rib from below and thus, it is possible to detachably hold the water-receiving cup.

A hand dryer according to a seventh aspect of the invention comprises a body case provided therein with a blower means and at its lower surface with an air-blowing nozzle, and a water receiver disposed below the body case and forming a hand-inserting space between the body case and the water receiver, the water receiver is detachable with respect to the body case in a state in which the body case is disposed, a box-like accommodating portion for accommodating a power cord which supplies electricity to the blower means is provided such that the box-like accommodating portion is opened at a back side of the body case.

According to this aspect, a length of the power cord is determined at the time of construction, and a remaining portion of the power cord is accommodated in the box-like accommodating portion and then, the body case is mounted to the wall. Therefore, the remaining portion of the power cord does not encumber for use and does not deteriorate the landscape.

A hand dryer according to an eighth aspect of the invention comprises a body case provided therein with a blower means and at its lower surface with an air-blowing nozzle, and a water receiver disposed below the body case and forming a hand-inserting space between the body case and the water receiver, the water receiver is detachable with respect to the body case in a state in which the body case is disposed, the body case is provided at its lower surface with an intake opening for drawing air in the hand-inserting space by suction force of the blower means, a water hole is provided in a wind path extending from the intake opening to the blower means, the water hole is located above the water receiver.

According to this aspect, even when water scattered from the hand at the time of use is drawn from the intake opening or water enters into the body case by the condensation, since the water drops to the water receiver from the water hole and is accumulated in the water-receiving cup. Therefore, there is no electrical trouble which may be caused by submerging the electrical component such as the hand detecting sensor, and a floor is not wet.

A hand dryer according to a ninth aspect of the invention comprises a body case provided therein with a blower means and at its lower surface with an air-blowing nozzle, and a water receiver disposed below the body case and forming a hand-inserting space between the body case and the water receiver, the water receiver is detachable with respect to the body case in a state in which the body case is disposed, the blower means includes a blower case having a display board, the display board is provided with a light-emitting diode, the body case is provided with a display hole capable of visually check the light-emitting diode, a LED holding portion is provided around the light-emitting diode.

According to this aspect, the LED holding portion can prevent the legs of the light-emitting diode from falling. Therefore, even if the front case is opened and closed at the time of construction or maintenance, the display hole of the front case and the LED can be aligned to each other.

BRIEF DESCRIPTION OF THE DRAWINGS

FIG. 16(*b*) is a partial detailed view showing a positional relation between the LED holding portion and legs of the LED.

BEST MODE FOR CARRYING OUT THE INVENTION

An embodiment of the present invention will be explained with reference to the drawings below.

Figure 1:
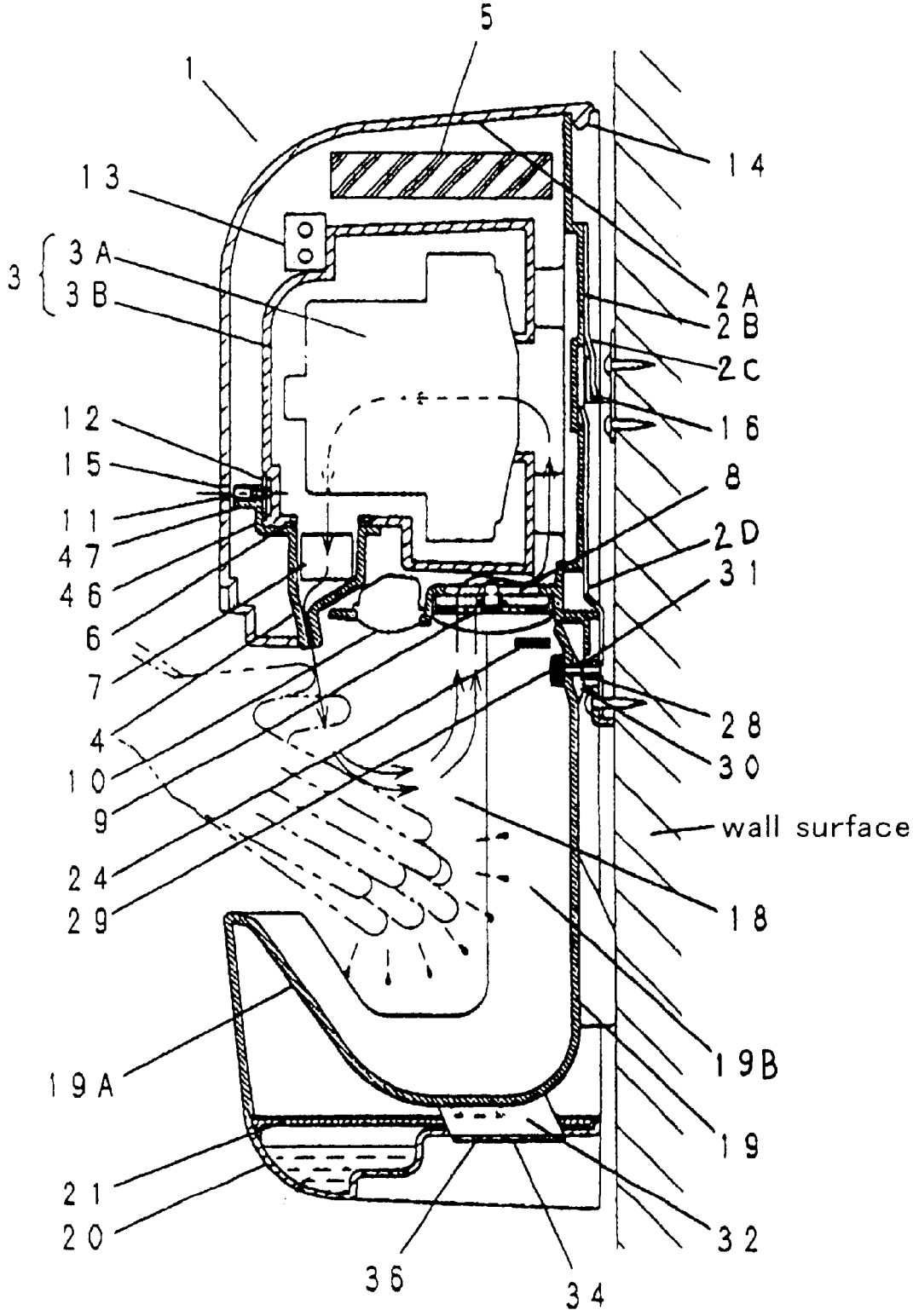
FIG. 1 is a side sectional view of a hand dryer according to an embodiment of the present invention.
Figure 2:
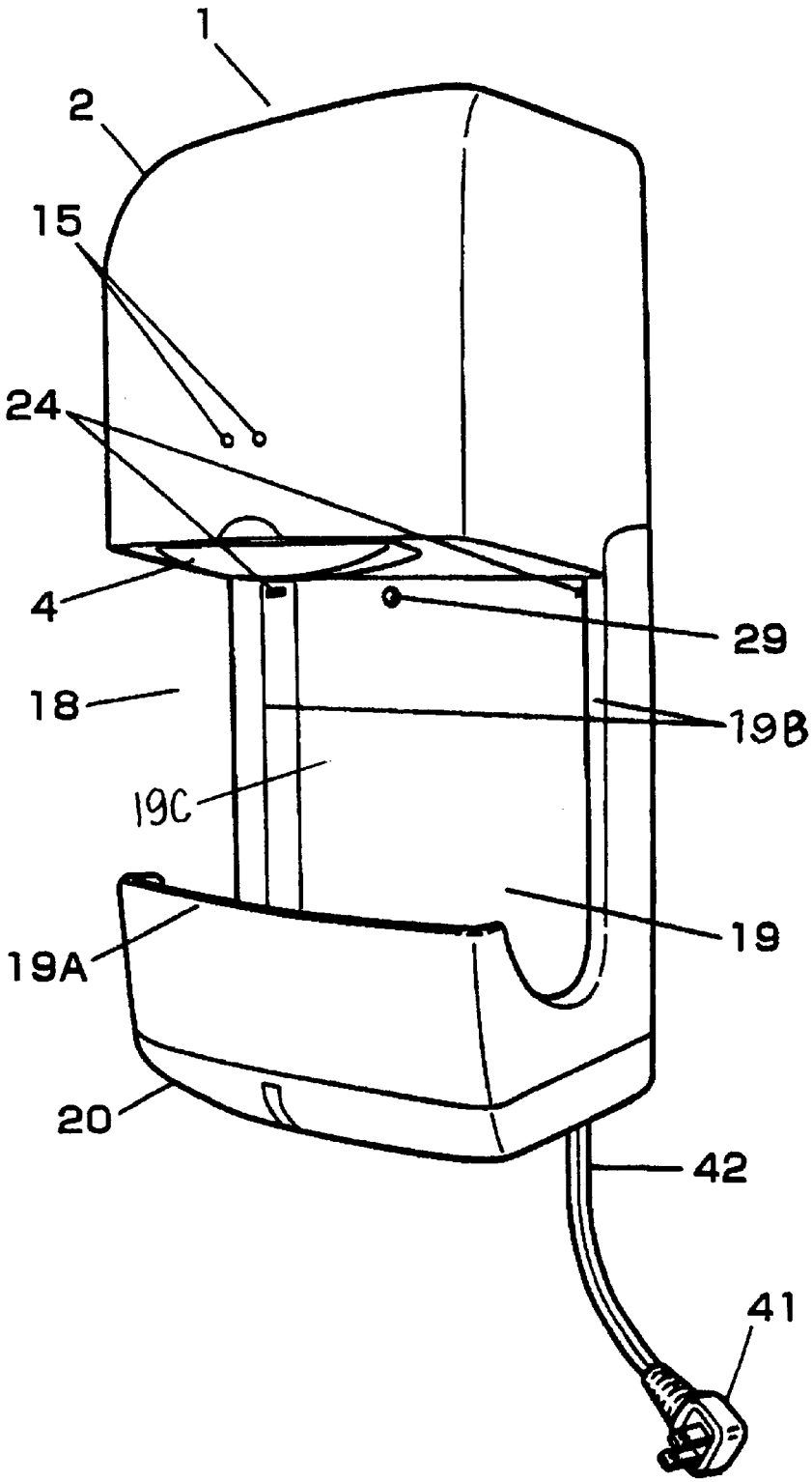
FIG. 2 is a perspective view of the hand dryer.
Figure 3:
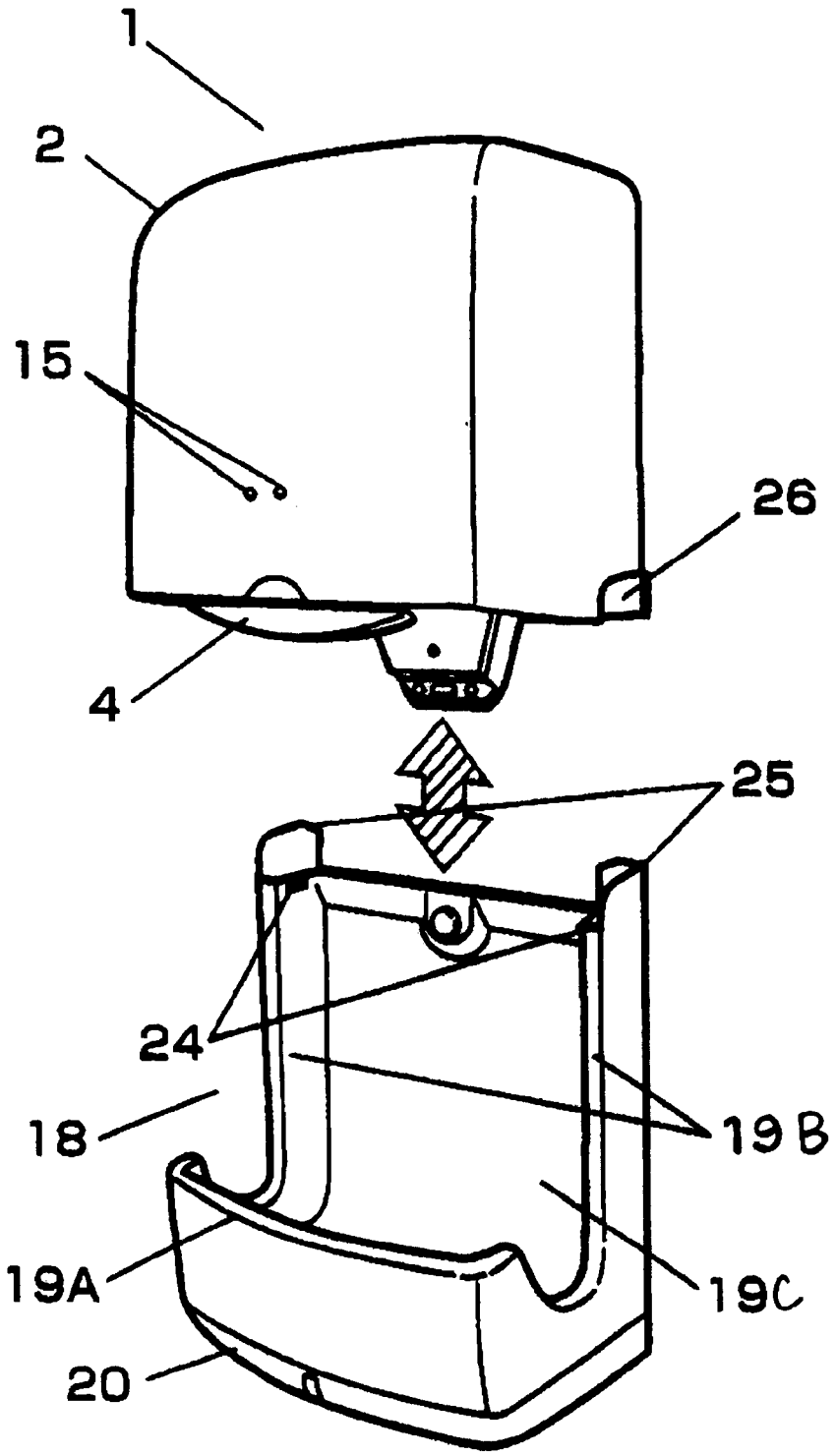
FIG. 3 is a perspective view of the hand dryer showing a state in which a water receiver is separated from a body case.
Figure 4:
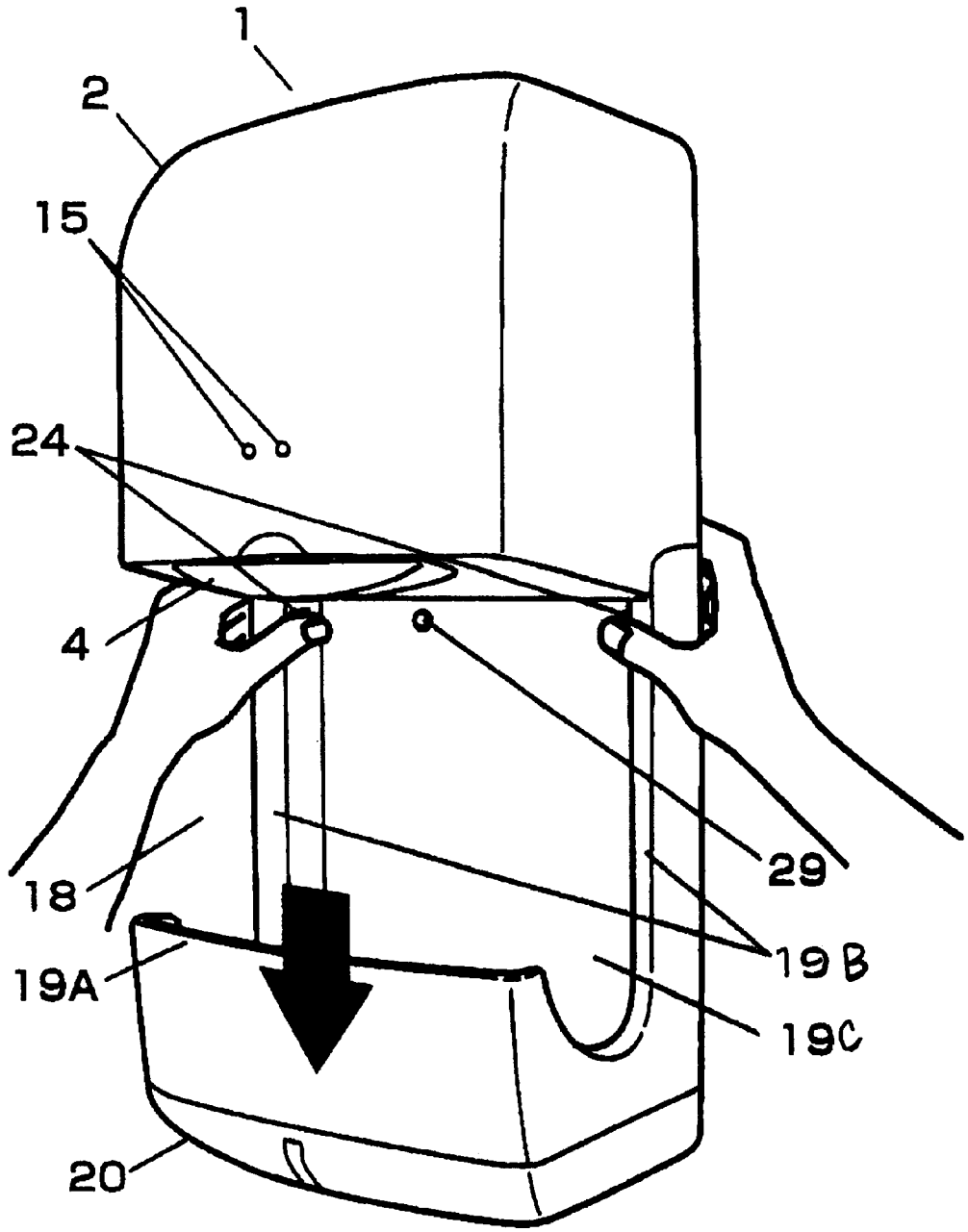
FIG. 4 is a perspective view of the hand dryer showing an operating state for separating the water receiver from the body case.
Figure 5:
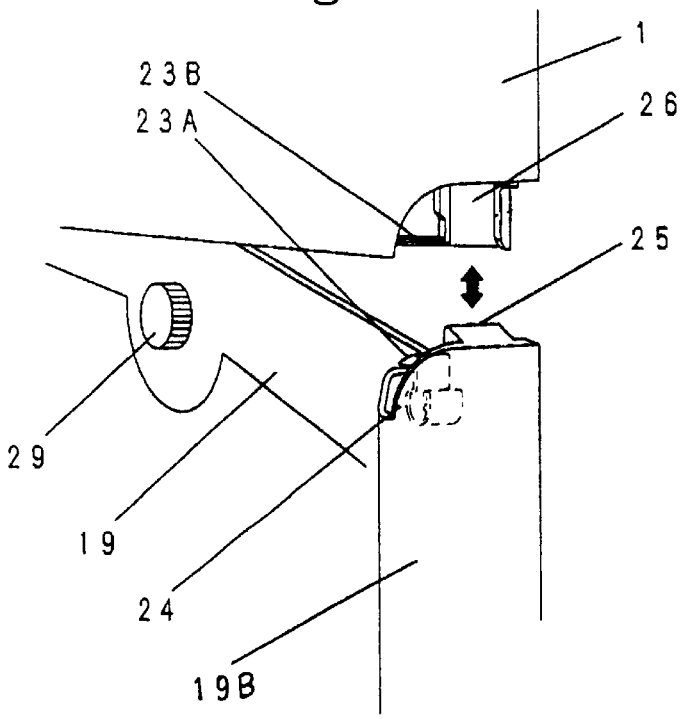
FIG. 5 is a perspective view of an essential portion of the hand dryer showing a water receiver-side connection portion and a body case-side connection portion.
Figure 6:
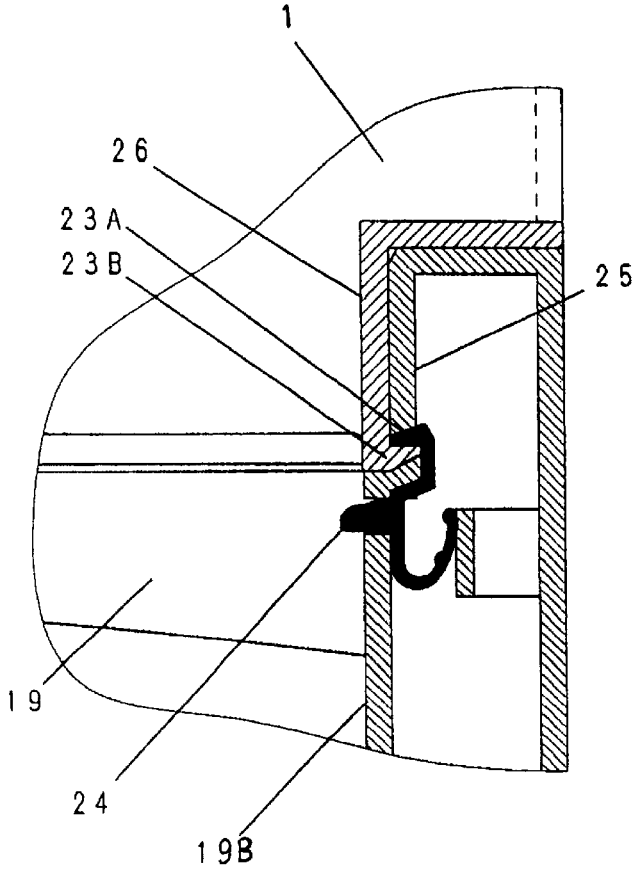
FIG. 6 is a front sectional view of an essential portion of the hand dryer showing a retained-state releasing means.
Figure 7:
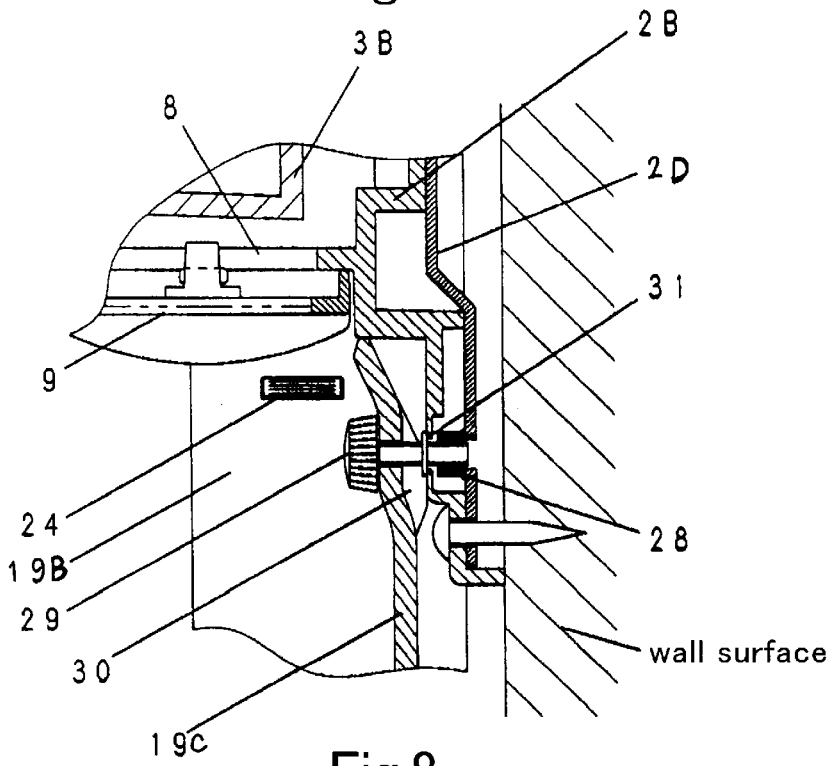
FIG. 7 is a side sectional view of an essential portion of the hand dryer showing a water receiver-fixing screw.
Figure 8:
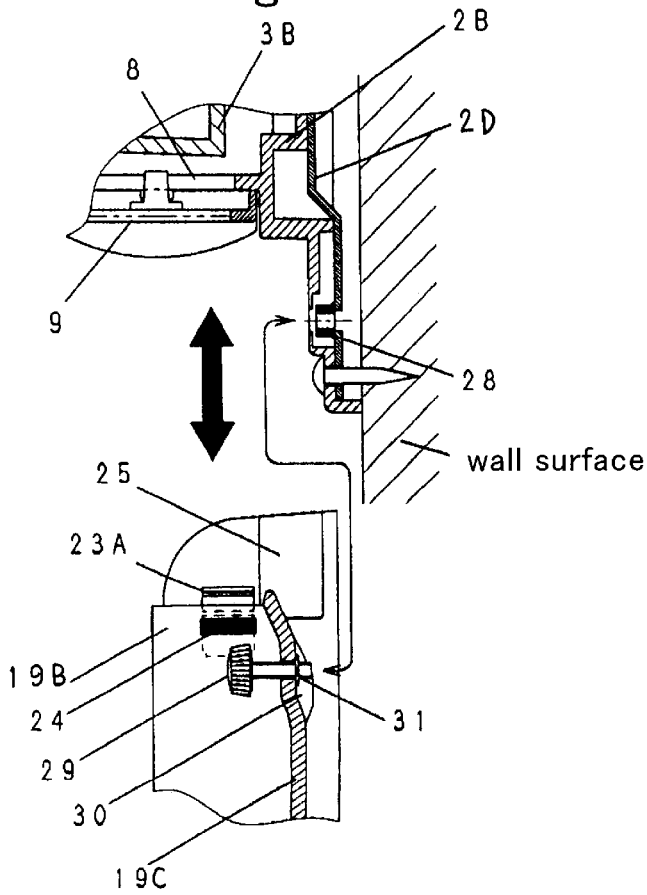
FIG. 8 is a side sectional view of an essential portion of the hand dryer showing the water receiver-fixing screw.

FIG. 1 is a side sectional view of a hand dryer according to an embodiment of the present invention. FIG. 2 is a perspective view of the hand dryer. FIG. 3 is a perspective view of the hand dryer showing a state in which a water receiver is separated from a body case. FIG. 4 is a perspective view of the hand dryer showing an operating state for separating the water receiver from the body case. FIG. 5 is a perspective view of an essential portion of the hand dryer showing a water receiver-side connection portion and a body case-side connection portion. FIG. 6 is a front sectional view of an essential portion of the hand dryer showing a retained-state releasing means. FIG. 7 is a side sectional view of an essential portion of the hand dryer showing a water receiver-fixing screw. FIG. 8 is a side sectional view of an essential portion of the hand dryer showing the water receiver-fixing screw.

As shown in FIGS. 1 to 3, 5 and 6, a body case 1 has an exterior comprising a front case 2A for covering a front surface, a ceiling surface and opposite side surfaces, and a rear case 2B for covering a wall surface side. A first rear hardware 2C and a second rear hardware 2D are provided on the rear case 2B on the wall surface side. The first rear hardware 2C includes a tongue piece which engages with a hooking hardware 16. The hooking hardware 16 is fixed to the wall surface by means of a screw or the like. The second rear hardware 2D can be fixed to the wall surface by means of a screw or the like.

The body case 1 is provided therein with an air-blowing nozzle 4 which is in communication with the blower means 3 for blowing air, and a control means 5 for controlling the electrical component. The blower means 3 comprises a blower motor 3A for generating air flow, and a blower case 3B. The blower means 3 and the air-blowing nozzle 4 are sealed by a packing 6 and connected to each other. A wind path in the air-blowing nozzle 4 is provided with heating means 7 for heating air. The body case 1 is provided at its lower surface with an injecting opening of the air-blowing nozzle 4, an intake opening 8,through which air is sent into the body case 1, a filter 9 for removing dust in the air drawn from the intake opening 8, and a hand detecting sensor 10 for detecting a hand by means of infrared rays. The blower case 3B is provided with a display board 12 for displaying an operating state on a LED (light-emitting diode) 11, and a terminal mount 13 for supplying electricity to the electrical component.

The front case 2A is engaged with the rear case 2B by a case pawl 14 provided on a rear end of the ceiling surface.

The front case 2A is detachably mounted to the rear case 2B by means of this case pawl 14. A front surface of the front case 2A is provided with a display hole 15 for emitting light of the LED 11 outside.

The body case 1 is fixed by hooking the first rear hardware 2C on the hooking hardware 16 fixed to the wall surface.

On the other hand, a hand-inserting space 18 for drying a hand is formed by the water receiver 19 below the body case 1. The water receiver 19 comprises a receiving portion 19A for covering a lower front surface, a back surface 19C connected to the receiving portion 19A for covering the wall surface side, and a pair of side surfaces 19B connected to the receiving portion 19A for forming rising portions from opposite sides of the back surface 19C. The pair of side surfaces 19B surround the hand-inserting space 18. Drops of water scattered from the hand are received mainly by the receiving portion 19A. A water-receiving cup 20 for accommodating the drops of water is provided on a back bottom surface of the water receiver 19. The water-receiving cup 20 is provided therein with a lid-like cup cover 21.

As shown in FIG. 5, each of the side surfaces 19B is provided at its upper portion with a water receiver-side retaining portion 23A. The body case 1 is provided at its lower portion with a body case-side retaining portion 23B. The water receiver-side retaining portion 23A moves upward and is retained with the body case-side retaining portion 23B.

The side surface 19B is provided at its upper potion with a retained-state releasing means 24 for releasing the retained state between the water receiver-side retaining portion 23A and the body case-side retaining portion 23B so that the water receiver 19 can be separated from the body case 1.

As shown in FIGS. 4 to 6, the retained-state releasing means 24 is provided on an inner surface of the side surface 19B. That is, the retained-state releasing means 24 has a projecting portion which is connected to the water receiver-side retaining portion 23A. If the projecting portion is pressed, the water receiver-side retaining portion 23A can resiliently be deformed. A through hole is formed in the inner surface of the side surface 19B, and the projecting portion is disposed in the through hole. In a state in which the projecting portion projects from the through hole, the water receiver-side retaining portion 23A is retained to the body case-side retaining portion 23B, and if the projecting portion is pushed into the through hole, the retained state between the water receiver-side retaining portion 23A and the body case-side retaining portion 23B is released.

As shown in FIGS. 5 and 6, the side surface 19B of the water receiver 19 is provided at its upper portion with the water receiver-side connection portion 25, and the body case 1 is provided at its opposite sides with body case-side connection portions 26 respectively. The water receiver-side connection portion 25 and the body case-side connection portion 26 constitute a guider capable of allowing the water receiver 19 to slide in the vertical direction with respect to the body case 1. Notches are formed in lower portions on opposite sides of the body case 1 on the wall surface side. Upper ends of the side surfaces 19B can be fitted into the notches. The water receiver-side connection portion 25 is connected to the body case-side connection portion 26 such that the water receiver-side connection portion 25 overlaps with the body case 1.

As shown in FIGS. 7 and 8, a female thread portion 28 is provided on a lower portion of the second rear hardware 2D which is provided on a back side of the rear case 2B. The female thread portion 28 is located below the body case 1, and is located at an upper portion of the back surface 19C. The second rear hardware 2D has a threaded hole through which the second rear hardware 2D is fixed to the wall surface. This threaded hole is also located below the body case 1 and is located in an upper portion of the back surface 19C.

A water receiver-fixing screw 29 is provided in an upper central portion of the back surface 19C of the water receiver 19. An abutting rib 30 for preventing the water receiver-fixing screw 29 from being too closely fastened is provided on a back surface of the back surface 19C at a location where the water receiver-fixing screw 29 is mounted. The water receiver-fixing screw 29 is provided with a washer 31 so that the water receiver-fixing screw 29 does not come out from the water receiver 19. Therefore, by fastening the water receiver-fixing screw 29 into the female thread portion 28, the water receiver 19 is fixed to the body case 1.

The operation of the hand dryer according to the embodiment will be explained below.

If a hand is inserted into the hand-inserting space 18 of the water receiver 19, the hand detecting sensor 10 detects the hand, and the blower means 3 and the heating means 7 are operated through the control means 5. By the operation of the blower means 3, air is drawn into the intake opening 8 through the filter 9, and becomes hot air by the heating means 7, and the hot air is sent out into the hand-inserting space 18 at high speed by the diameter-reduced air-blowing nozzle 4.

The sent out high speed hot air collides against a surface of the hand, and scatters and dries the drops of water. The scattered drops of water are received by the water receiver 19 and accumulated in the water-receiving cup 20. By repeating this action, dirt and dust in the outside air are collected by the filter 9, and water is accumulated in the water-receiving cup 20.

The operational states such as "operating", "stop", "abnormal" and the like are displayed on the LED 11 of the display board 12 so that the operational states can be checked from outside through the display hole 15 of the front case 2A.

When the water receiver 19 is to be detached from the body case 1, if the retained-state releasing means 24 is pushed, the water receiver-side retaining portion 23A is detached from the body case-side retaining portion 23B, and the water receiver 19 can be separated from the body case 1. When the water receiver 19 is to be mounted to the body case 1 on the contrary, if the water receiver 19 is set to the body case 1, the water receiver-side retaining portion 23A is hooked on the body case-side retaining portion 23B, and the water receiver 19 can be connected to the body case 1.

In this manner, the water receiver 19 can be attached to and detached from the body case 1 in a state in which the body case 1 is installed. Therefore, a user can freely attach and detach the water receiver 19 depending upon a place or use, and when the water receiver 19 is made dirty, only the water receiver 19 can be detached and washed whole.

When the water receiver 19 is to be separated from the body case 1, since the retained-state releasing means 24 exists on each of the inner surfaces of the side surfaces 19B of the water receiver 19, both hands can grasp the left and right side surfaces 19B and the retained-state releasing means 24 can be pushed by thumbs which can easily be strained. Therefore, the operation can be facilitated, and the outward appearance is not deteriorated by the retained-state releasing means 24.

When the water receiver 19 is to be mounted to the body case 1, the water receiver-side connection portion 25 is inserted into the body case-side connection portion 26 and fixed. At that time, the water receiver-side connection portion 25 and the body case-side connection portion 26 constitute the guider which can allow the water receiver 19 to slide in the vertical direction with respect to the body case 1. Therefore, rattle of the front and rear portions of the water receiver 19 can be eliminated by holding the guider.

As shown in FIGS. 7 and 8, after the water receiver 19 is mounted to the body case 1 by the water receiver-side retaining portion 23A and the body case-side retaining portion 23B, if the water receiver-fixing screw 29 is screwed into the female thread portion 28, the water receiver 19 is sandwiched and fixed between the water receiver-fixing screw 29 and the female thread portion 28. When the water receiver 19 is to be detached on the contrary, the water receiver-fixing screw 29 is first loosened and removed from the female thread portion 28 and then, if the retained-state releasing means 24 is pushed, the water receiver-side retaining portion 23A is detached from the body case-side retaining portion 23B and can be separated from the body case 1. At that time, if the water receiver-fixing screw 29 is loosened, the water receiver-fixing screw 29 comes off forward, the falling-preventing washer 31 itself is also pushed out toward a tip end of the water receiver-fixing screw 29. However, since the water receiver 19 is floated by the abutting rib 30, the washer 31 does not fall.

Next, the attaching and detaching structure of the water receiver and the water-receiving cup will be explained next using FIGS. 9 and 10.

Figure 9:
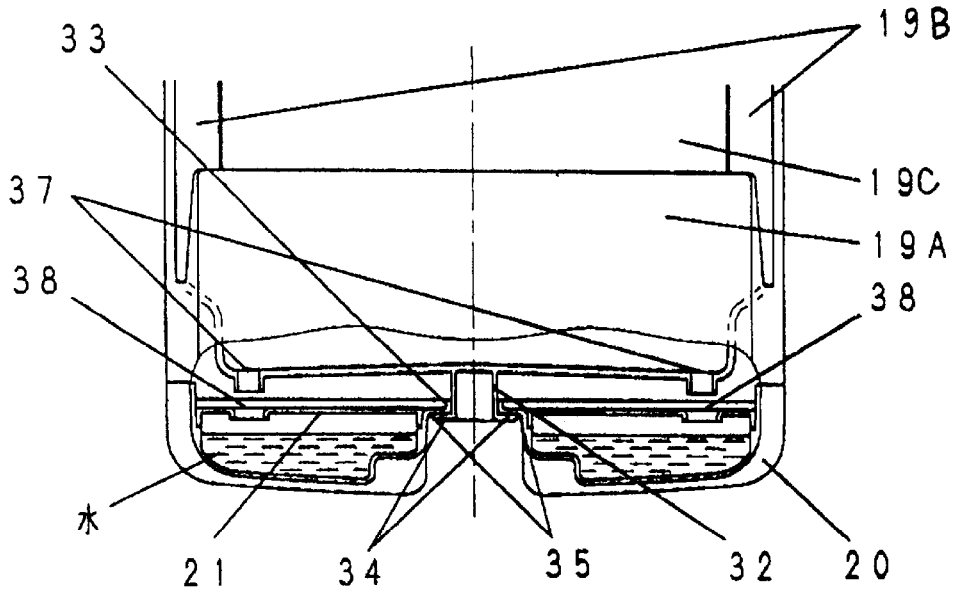
FIG. 9 is a front sectional view of an essential portion of the hand dryer showing the water receiver and a water-receiving cup.

FIG. 9 is a front sectional view of an essential portion of the hand dryer showing the water receiver and a water-receiving cup. FIG. 10 is a bottom, view of the hand dryer showing the water receiver and the water-receiving cup.

Figure 10:
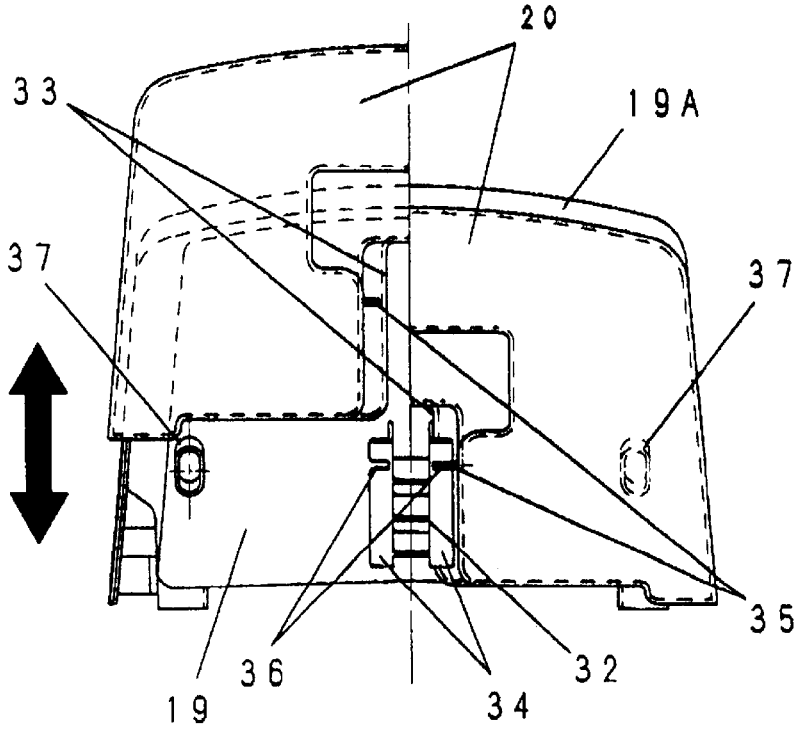
FIG. 10 is a bottom view of the hand dryer showing the water receiver and the water-receiving cup.

As shown in FIGS. 9 and 10, a reversed T-shaped rail 32 is provided on a substantially central portion of a back bottom surface of the water receiver 19 in the longitudinal direction. Lateral ribs 34 are provided on opposite sides of the rail 32. Notches 36 are formed in front of the lateral ribs 34.

On the other hand, a guide groove 33 is formed in substantially a central portion on an upper surface of the water-receiving cup 20 by notching from a rear portion of the upper surface. The guide groove 33 is wider than a width of the rail 32, and the rail 32 can be located in the guide groove 33. Lateral ribs 34 can slide on the opposite sides of the guide groove 33. Cup projecting portions 35 which engage with the notches 36 are formed in front of the opposite sides of the guide groove 33.

With the above structure, the water-receiving cup 20 is suspended by the lateral ribs 34 formed on the opposite sides of the rail 32, and the water-receiving cup 20 can slide with respect to the water receiver 19 in the longitudinal direction. In a state in which the water-receiving cup 20 is mounted to the water receiver 19, the cup projecting portions 35 are accommodated in the notches 36 of the rail 32. Water receiver holes 37 provided in left and right portions of the water receiver 19 and cup cover holes 38 provided in the cup cover 21 are formed such that their positions become the same in a state in which the water-receiving cup 20 is mounted to the water receiver 19.

With the above structure, drops of water scattered by high speed hot air from the air-blowing nozzle 4 are received by the water receiver 19, and collected in the water-receiving cup 20 from the water receiver holes 37 through the cup cover holes 38.

The water-receiving cup 20 is mounted in such a manner that the guide groove 33 of the water-receiving cup 20 is inserted to the rail 32 of the water receiver 19 from a front side, and the water-receiving cup 20 is supported by the lateral ribs 34 from below. When the guide grooves 33 of the water-receiving cup 20 are to be inserted to the rail 32 of the water receiver 19, the cup projecting portions 35 ride over the lateral ribs 34 and if the guide grooves 33 are further inserted, the cup projecting portions 35 are fitted into the notches 36 and can be fixed at appropriate positions. If the water-receiving cup 20 is pulled out forward on the contrary, the cup projecting portions 35 ride over the lateral ribs 34, and if the water-receiving cup 20 is further pulled out, the cup projecting portions 35 are disengaged from the lateral ribs 34, and the water-receiving cup 20 can be detached. In this manner, since the cup projecting portions 35 are fitted into and disengaged from the notches 36, click feeling when the water-receiving cup 20 is attached and detached can be obtained.

Next, accommodation of the power cord of the hand dryer will be explained.

Figure 11:
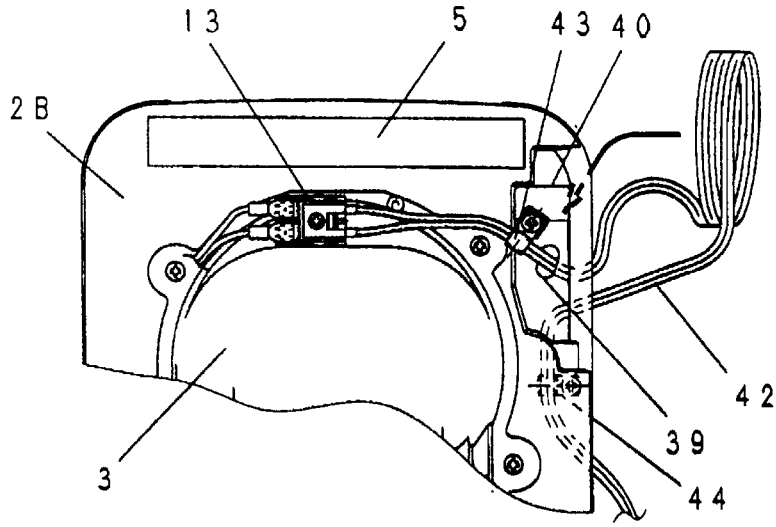
FIG. 11 is a front view of an essential portion of the hand dryer showing an interior of the body case.
Figure 12:
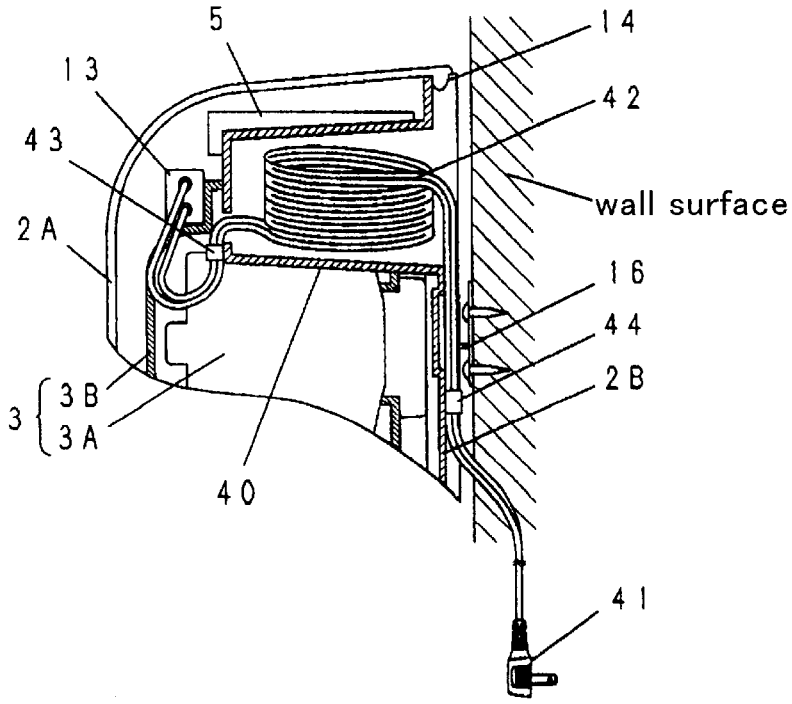
FIG. 12 is a side sectional view of an essential portion of the hand dryer showing a state in which a power cord is accommodated in a box-like accommodating portion.

FIG. 11 is a front view of an essential portion of the hand dryer showing an interior of the body case. FIG. 12 is a side sectional view of an essential portion of the hand dryer showing a state in which a power cord is accommodated in a box-like accommodating portion.

As shown in FIGS. 11 and 12, a box-like accommodating portion 40 has a cord-retracting opening 39. The box-like accommodating portion 40 projects from a rear portion of the body case 1 into the body case 1. That is, a back surface side of the box-like accommodating portion 40 is opened. A tip end of one of ends of the power cord 42 has a power supply plug 41, and the other end of the power cord 42 is pulled into the body case 1 from the back side of the body case 1 through the cord-retracting opening 39 and is connected to the terminal mount 13. The power cord 42 can be fixed by means of a clip A 43 near an inlet of the cord-retracting opening 39 and a clip B 44 on the back side of the body case 1.

First, the power cord 42 is connected to the terminal mount 13, the power cord 42 is fixed by means of the clip A 43 in the body case 1, a necessary length of the power cord 42 to a place where electricity can be supplied from the power supply is determined, and the power cord 42 is fixed by means of the clip B 44. Then, remaining power cord 42 is wound and accommodated in the box-like accommodating portion 40, the second rear hardware 2D is hooked on the hooking hardware 16 to fix the body case 1.

Next, a structure for preventing water from entering into the body case will be explained.

Figure 13:
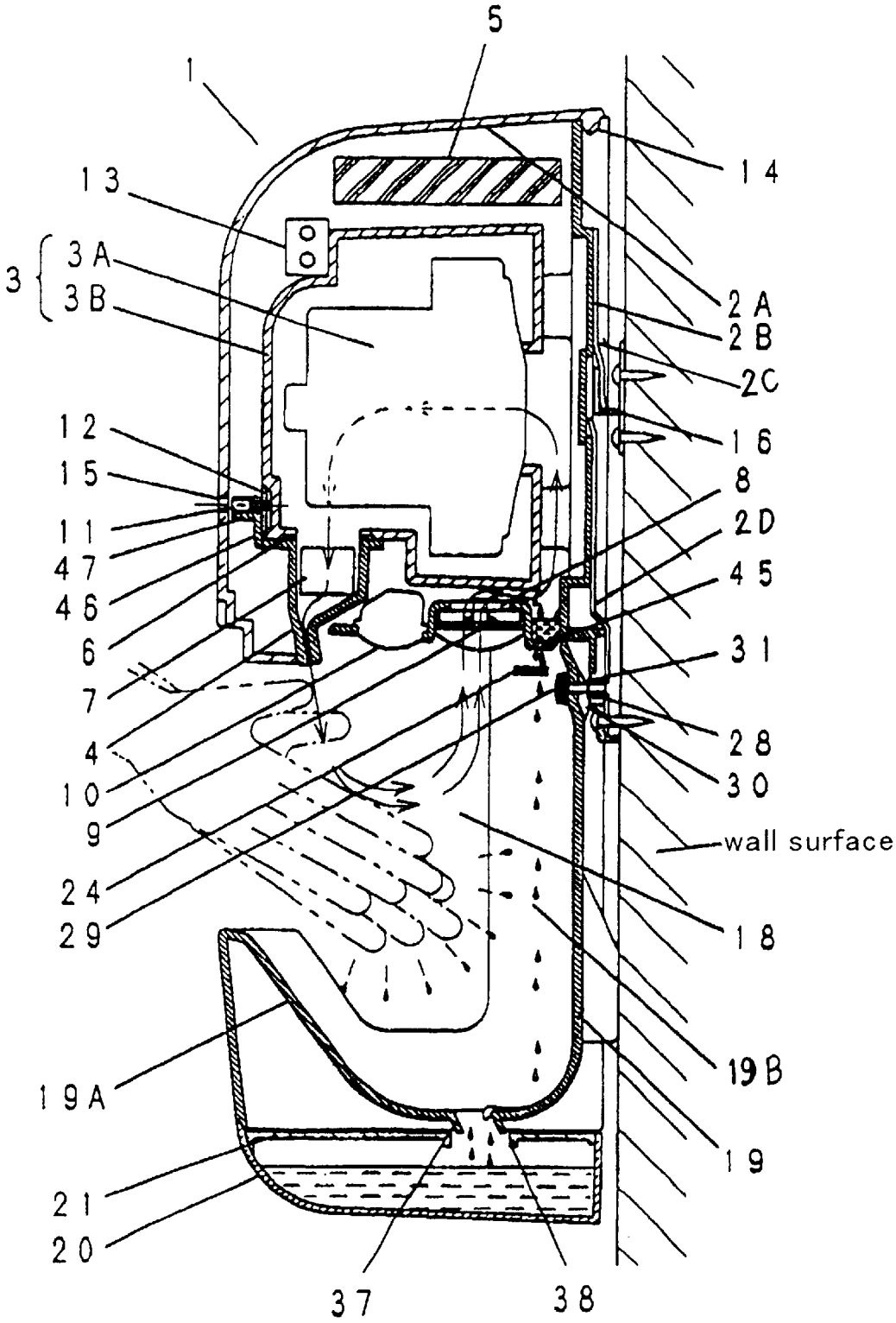
FIG. 13 is a side sectional view of the hand dryer showing a flow of water when water enters into the body case.

FIG. 13 is a side sectional view of the hand dryer showing a flow of water when water enters into the body case.

As shown in FIG. 13, a water hole 45 is provided in a lowermost portion of the body case 1 and directly above the receiving portion 19A of the water receiver 19.

With the above structure, when body case 1 is subjected to water or drops of water scattered from a hand is drawing from the intake opening 8 or water enters into the body case 1 by condensation or the like, since the water hole 45 is formed in the lowermost portion of the body case 1, water flows toward the lowermost portion of the body case 1 and is discharged outside from the water hole 45 without submerging an electrical component such as the hand detecting sensor 10. Water which is discharged out is received by the receiving portion 19A of the water receiver 19 located directly below, and can be accommodated in the water-receiving cup 20 from the water receiver holes 37 through the cup cover holes 38.

Next, a structure in which even if the front case is opened and closed, positions of the display hole and the LED are not deviated from each other will be explained.

Figure 14:
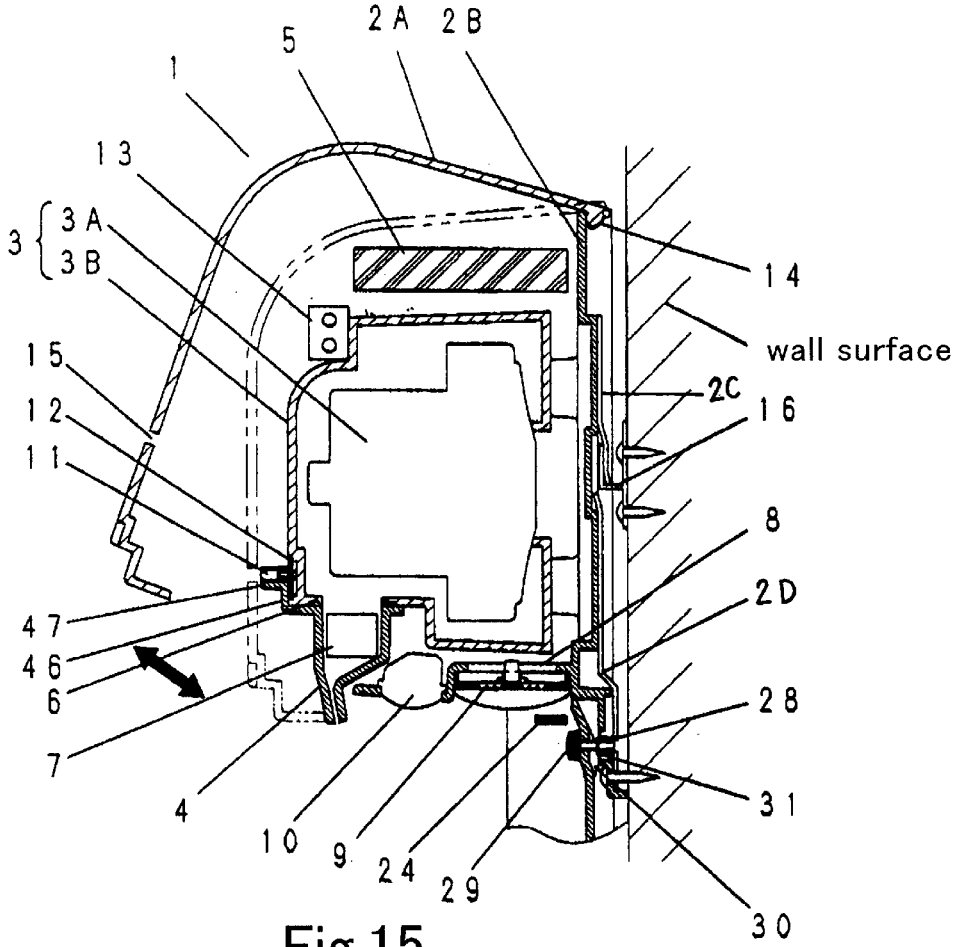
FIG. 14 is a side sectional view of the hand dryer showing a positional relation between a front case and a LED (light-emitting diode).
Figure 15:
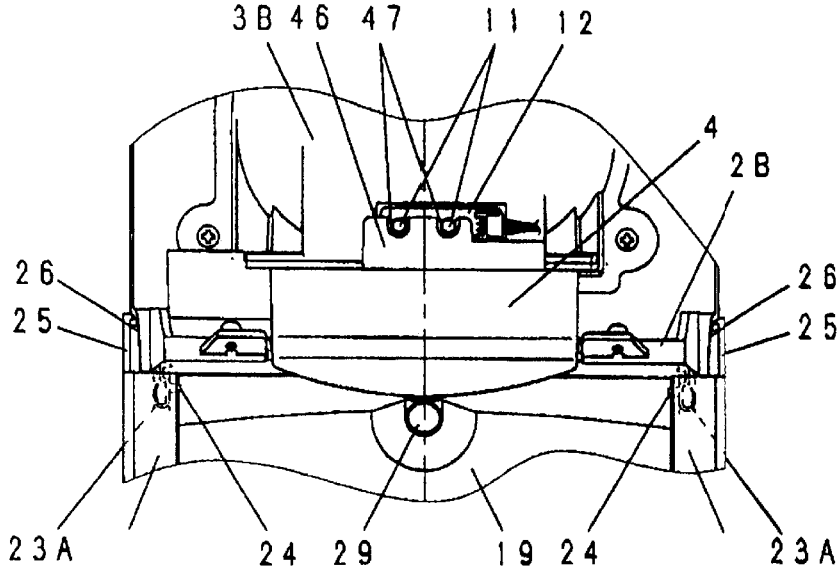
FIG. 15 is a partial detailed view showing the LED and its surroundings.
Figure 16A:
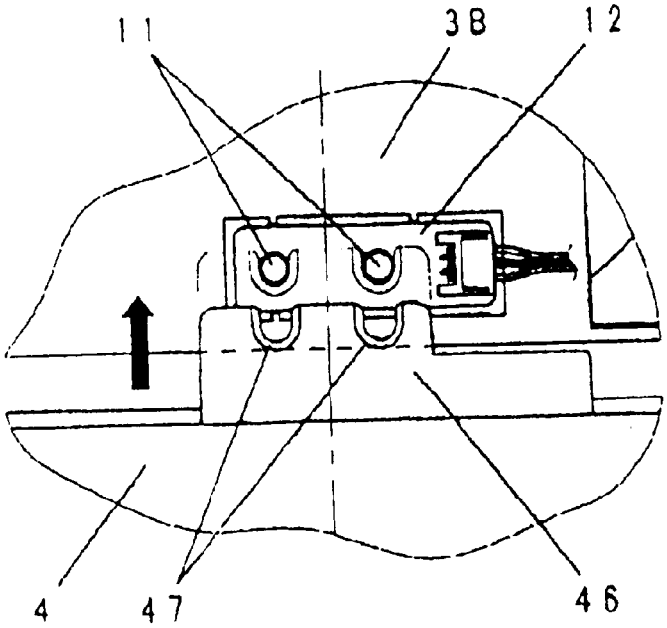
FIG. 16(*a*) is a partial detailed view showing a state until a LED holding portion holds the LED.
Figure 16B:
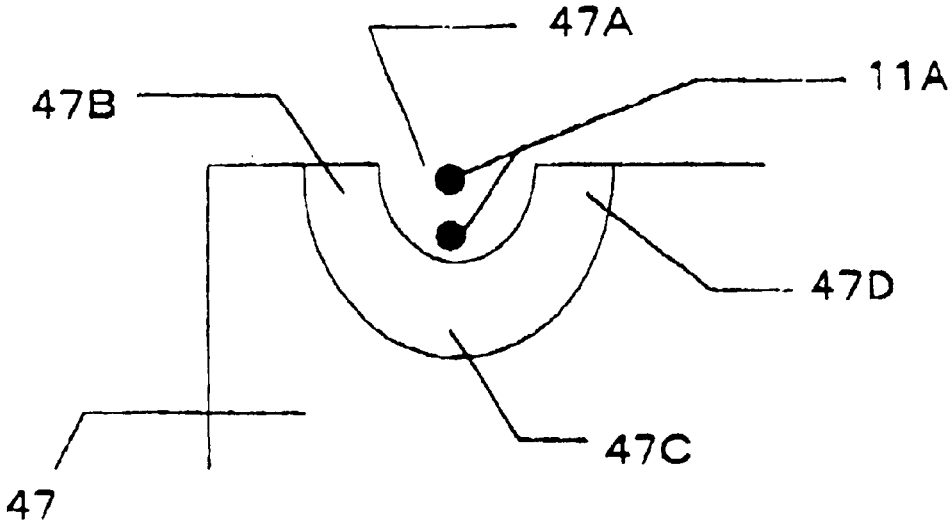
Figure 17:
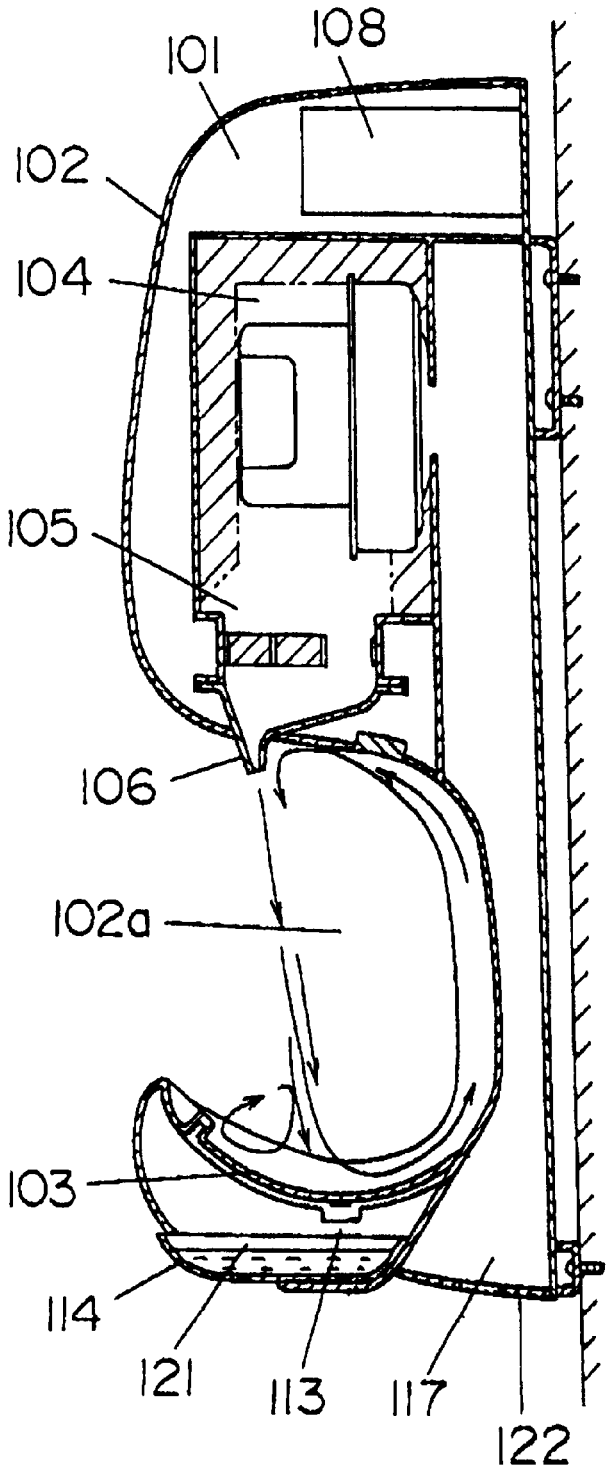
FIG. 17 is a side sectional view of a conventional hand dryer.

FIG. 14 is a side sectional view of the hand dryer showing a positional relation between a front case and a LED (light-emitting diode). FIG. 15 is a partial detailed view showing the LED and its surroundings. FIG. 16(*a*) is a partial detailed view showing a state until a LED holding portion holds the LED. FIG. 16(*b*) is a partial detailed view showing a positional relation between the LED holding portion and legs of the LED.

As shown in FIGS. 14 to 16, the body case 1 comprises the rear case 2B provided on a back surface of the body case 1, and a front case 2A which is detachably mounted to the front surface of the body case 1. The front case 2A is opened and closed around the case pawl 14 as a fulcrum. The front case 2A includes the display hole 15. The front surface of the blower case 3B includes the display board 12. The LED 11 for indicating the ON/OFF of the power supply and trouble of the motor is mounted to the display board 12. The display hole 15 is provided at a position where the LED 11 of the display board 12 can be visually checked when the front case 2A is mounted to the body case 1.

The air-blowing nozzle 4 is connected and fixed to the blower case 3B.

A tongue 46 is provided on the air-blowing nozzle 4 on its side which is connected and fixed to the blower case 3B. The tongue 46 is provided with a LED holding portion 47 comprising an arc rib.

The LED 11 is provided such that its two legs 11A are arranged in the vertical direction. The LED holding portion 47 comprises a right holding portion 47D and a left holding portion 47B which are disposed such as to sandwich the legs 11A of the LED 11 and the nozzle-side holding portion 47C which is disposed in a perpendicular direction with respect to an arrangement direction of the legs 11A of the LED 11. The LED holding portion 47 is formed with an opening 47A on the side which is opposed to the nozzle-side holding portion 47C.

Although two LEDs were used in the lateral direction in the embodiment, the number of LEDs is not limited to two of course.

With the above structure, when the air-blowing nozzle 4 is to be mounted to the blower case 3B, the display board 12 is pushed by the tongue 46 of the air-blowing nozzle 4 and held. Heads of the LED 11 can be held perpendicularly to the display board 12 by guiding the LED 11 using the LED holding portion 47. With this arrangement, when the front case 2A is opened and closed, it is possible to prevent the LED 11 and the display hole 15 of the front case 2A from being deviated from each other.

INDUSTRIAL APPLICABILITY

According to the present invention as described above, a user can freely attach and detach the water receiver depending upon place or use, and when the water receiver is made dirty, only the water receiver can be detached and washed whole.

When a user detaches the water receiver, he or she grasps the both side surfaces of the water receiver and detaches the water receiver. Since the retained-state releasing means is provided on each of the inner surfaces of the side surfaces, the operation can be carried out using thumbs which can easily be strained, and the retained-state releasing means can be provided without deteriorating the outward appearance.

When the water receiver is connected to the body case, since the water receiver-side connection portion is fitted along the body water receiver-side connection portion, the connection between the body case and the water receiver is strengthened by the guider, and the rattle in the front and rear portions of the water receiver can be eliminated.

When the water receiver is mounted to the body case, if the water receiver-fixing screw is fastened to the female thread portion, the body case and the water receiver can reliably be fixed to each other, and it is possible to prevent the water receiver from coming out.

If the guide groove of the water-receiving cup is inserted to the reversed T-shaped rail, the water-receiving cup is supported by the reversed T-shaped lateral rib from below and thus, it is possible to detachably hold the water-receiving cup.

A length of the power cord is determined at the time of construction, and a remaining portion of the power cord is accommodated in the box-like accommodating portion and then, the body case is mounted to the wall. Therefore, the remaining portion of the power cord does not encumber for use and does not deteriorate the landscape.

Even when splash water is drawn from the intake opening or water enters into the body case by the condensation, since all water is introduced to the lowermost portion in the body case, drops to the water receiver from the water hole and is accumulated in the water-receiving cup. Therefore, there is no trouble in the electrical component which may be caused if water enters, and a floor is not wet or made dirty.

When the front case is detached at the time of construction or maintenance, the legs of the LED are prone to fall because a hand or the LED may hit against the front case. However, if the air-blowing nozzle is mounted to the blower case, the LED head is guided from the opening of the LED holding portion provided on the tongue of the air-blowing nozzle and accommodated in the LED holding portion, and it is possible to prevent the legs of the LED from falling in the perpendicular direction with respect to the arrangement direction of the legs. Therefore, even if the front case is detached at the time of construction or maintenance, the positions of the LED and the display hole of the front case are not deviated from each other.

What is claimed is:

1. A hand dryer to be mounted on a wall surface, the hand dryer comprising a body case mounted on the wall surface and comprising a blower with an air-blowing nozzle at a lower surface of the body case, and a water receiver disposed below said body case and removably attached to the body case, wherein the body case and the water receiver form a hand-inserting space between said body case and said water receiver, wherein said water receiver comprises a water-receiving portion between a lower front surface, and a back surface thereof, wherein the back surface is generally parallel to and covers the wall surface, and wherein said water receiver comprises a pair of water receiver sides which are connected to said back surface to constitute rising portions extending, in a direction away from the wall surface, from opposite sides of said back surface, wherein said body case comprises a pair of body case sides respectively disposed on opposite sides of said body case and extending, in a direction away from the wall surface, from opposite sides of said body case; and wherein the water receiver sides comprise respective water receiver-side retaining portions on upper portions of said water receiver sides, and wherein the body case sides comprise respective body case-side retaining portions on opposite sides of said body case, wherein said water receiver is mounted to said body case by said water receiver-side retaining portions and said body case-side retaining portions; and wherein the body case sides and the water receiver sides are flush.

2. A hand dryer according to claim 1, wherein the water receiver-side retaining portions and the body case-side retaining portions further comprise latches coupling each body case side to the respective water receiver side.

3. The hand dryer according to claim 1, comprising a guider sliding said water receiver in a vertical direction with respect to said body case and comprising a water receiver-side connection portion and a body case-side connection portion.

4. The hand dryer according to claim 1, wherein said back surface comprises at its upper central portion a water receiver-fixing screw which connects said body case to said water receiver.

5. The hand dryer according to claim 1, a water-receiving cup detachably mounted to a lower portion of said water receiver.

6. A hand dryer to be mounted on a wall surface, the hand dryer comprising a body case mounted on the wall surface and comprising a blower with an air-blowing nozzle at a lower surface of the body case, and a water receiver disposed below said body case and removably attached to the body case, wherein the body case and the water receiver form a hand-inserting space between said body case and said water receiver, wherein said water receiver includes, at a lower portion thereof, a water-receiving cup, said water receiver includes, on a substantially central portion of a bottom thereof, a reversed T-shaped rail extending in a longitudinal direction away from the wall surface, said water-receiving cup includes, on an upper surface thereof, a guide groove formed by notching the upper surface from a rear portion thereof, and the guide groove is slidable on the rail.

7. A hand dryer to be mounted on a wall surface, the hand dryer comprising a body case mounted on the wall surface and comprising a blower with an air-blowing nozzle at a lower surface of the body case, and a water receiver disposed below said body case and removably attached to the body case, wherein the body case and the water receiver form a hand-inserting space between said body case and said water receiver, wherein the body case comprises, inside an outer wall of the body case, a box-like accommodating portion for accommodating a power cord which supplies electricity to said blower means, wherein said box-like accommodating portion opens at a back side of said body case, and wherein said body case back surface is spaced from the wall surface.

8. A hand dryer to be mounted on a wall surface, the hand dryer comprising a body case mounted on the wall surface and comprising a blower with an air-blowing nozzle at a lower surface of the body case, and a water receiver disposed below said body case and removably attached to the body case, wherein the body case and the water receiver form a hand-inserting space between said body case and said water receiver, wherein said body case includes, at a lower surface thereof, an intake opening for drawing air in said hand-inserting space by suction force of said blower means, and a water hole located on a lower surface of said body case between said intake opening and said blower means, above said water receiver.

* * * * *